US011094450B2

(12) United States Patent
Drespling et al.

(10) Patent No.: US 11,094,450 B2
(45) Date of Patent: Aug. 17, 2021

(54) CORE COMPONENT

(71) Applicant: EPCOS AG, Munich (DE)

(72) Inventors: Anneliese Drespling, Heidenheim (DE); Dirk Beckmann, Heidenheim (DE)

(73) Assignee: EPCOS AG, Munich (DE)

( * ) Notice: Subject to any disclaimer, the term of this patent is extended or adjusted under 35 U.S.C. 154(b) by 897 days.

(21) Appl. No.: 15/304,421

(22) PCT Filed: Apr. 13, 2015

(86) PCT No.: PCT/EP2015/057954
§ 371 (c)(1),
(2) Date: Oct. 14, 2016

(87) PCT Pub. No.: WO2015/158656
PCT Pub. Date: Oct. 22, 2015

(65) Prior Publication Data

US 2017/0040102 A1 Feb. 9, 2017

(30) Foreign Application Priority Data

Apr. 15, 2014 (DE) ..... 10 2014 105 370.2

(51) Int. Cl.

| | |
|---|---|
| ***H01F 27/24*** | (2006.01) |
| ***H01F 27/255*** | (2006.01) |
| ***H01F 27/28*** | (2006.01) |
| ***H01F 3/00*** | (2006.01) |

(52) U.S. Cl.
CPC ..... *H01F 27/2823* (2013.01); *H01F 3/00* (2013.01); *H01F 27/24* (2013.01)

(58) Field of Classification Search
CPC ..... H01F 27/24; H01F 27/255
See application file for complete search history.

(56) References Cited

U.S. PATENT DOCUMENTS

| | | | | |
|---|---|---|---|---|
| 2,628,342 | A * | 2/1953 | Taylor | H04M 1/02 336/45 |
| 4,424,504 | A | 1/1984 | Mitsui et al. | |
| 5,548,367 | A * | 8/1996 | Katagiri | G03B 7/10 396/463 |
| 6,657,528 | B1 | 12/2003 | Tang | |
| 6,696,913 | B2 | 2/2004 | Meuche et al. | |
| RE39,453 | E * | 1/2007 | Boytor | H01F 27/027 29/602.1 |
| 2002/0190830 | A1 * | 12/2002 | Matsumoto | H01F 3/10 336/83 |
| 2004/0263285 | A1 | 12/2004 | Suzuki et al. | |
| 2005/0104702 | A1 | 5/2005 | Sano | |
| 2005/0237141 | A1 * | 10/2005 | Hirai | H01F 41/10 336/83 |

(Continued)

FOREIGN PATENT DOCUMENTS

| | | | |
|---|---|---|---|
| DE | 10056945 | A1 | 5/2002 |
| EP | 0068745 | A1 | 1/1983 |

(Continued)

*Primary Examiner* — Elvin G Enad
*Assistant Examiner* — Malcolm Barnes
(74) *Attorney, Agent, or Firm* — Slater Matsil, LLP

(57) ABSTRACT

A core component is disclosed. In an embodiment, the core component includes at least one edge that has a transition, wherein the transition is asymmetrical.

18 Claims, 3 Drawing Sheets

(56) References Cited

U.S. PATENT DOCUMENTS

2006/0022788 A1 2/2006 Sasamori et al.
2007/0018770 A1* 1/2007 Kamio ..... H01F 27/292 336/221
2007/0041162 A1* 2/2007 Sedio ..... H05K 1/181 361/714
2008/0290975 A1* 11/2008 Watanabe ..... H01F 27/292 336/90
2010/0253456 A1* 10/2010 Yan ..... H01F 27/306 336/83
2011/0006870 A1* 1/2011 Sakamoto ..... H01F 1/26 336/221
2012/0119859 A1* 5/2012 Nishino ..... H01F 17/045 335/297
2013/0021128 A1* 1/2013 Yan ..... H01F 17/045 336/83
2013/0027161 A1* 1/2013 Urano ..... H01F 17/04 336/83
2013/0307657 A1* 11/2013 Ohaga ..... H01F 27/292 336/192
2015/0116070 A1* 4/2015 Arai ..... H01F 17/045 336/192
2015/0310983 A1* 10/2015 Nguyen ..... H01F 27/02 336/92

FOREIGN PATENT DOCUMENTS

JP S52222523 U 2/1977
JP 559456 A 1/1980
JP S57201824 U 12/1982
JP S58114012 U 8/1983
JP 0435009 A 2/1992
JP H0543511 U 6/1993
JP 3004417 U 11/1994
JP H07142257 A 6/1995
JP 2000021651 A * 1/2000
JP 2005109422 A 4/2005
JP 2005109422 A * 4/2005 ..... H01F 27/255
JP 2005311074 A 11/2005
JP 2006066534 A 3/2006
JP 2007027461 A 2/2007
JP 2012015487 A 1/2012
JP 2012174980 A 9/2012

* cited by examiner

CORE COMPONENT

This patent application is a national phase filing under section 371 of PCT/EP2015/057954, filed Apr. 13, 2015, which claims the priority of German patent application 10 2014 105 370.2, filed Apr. 15, 2014, each of which is incorporated herein by reference in its entirety.

TECHNICAL FIELD

A core component for an inductive construction element is disclosed. The core component may be employed in an inductor or a transformer, for example.

BACKGROUND

Core components in which one or a plurality of edges have a transition in the form of a symmetrical rounding or of a symmetrical chamfer are known.

SUMMARY OF THE INVENTION

A core component that may be configured as a ferrite core, for example, is disclosed. The core component has at least one edge with a transition. The edge is formed in particular by the convergence of one first and one second surface. The transition is configured in particular between the two surfaces. For example, the first and the second surface are disposed so as to be mutually perpendicular. A sharp edge which is particularly prone to fissuring in the core component is to be avoided by way of the transition. The edge is preferably an inner edge. In one further embodiment, the edge is an outer edge.

The core component has regions with dissimilar heights, for example. The core component has at least one step, for example. Herein, the edge is configured between the regions of dissimilar heights, in particular in a step. Regions of dissimilar heights converge less abruptly by way of the transition. In particular, the component in the region of the transition has a height that is between a first and a second height of the component.

The transition is configured so as to be non-symmetrical. In particular, the transition is configured to be non-symmetrical in relation to a mirror image on the bisectrix of the imaginary sharp edge. It has been established that the robustness of the core component may be increased by way of a non-symmetrical transition. In particular, mechanical stresses in the core component may be reduced, and stress peaks may be avoided.

The transition in dissimilar directions preferably has dissimilar edge dimensions. A first edge dimension herein preferably indicates the extent of the transition in a manner perpendicular to the edge profile and in the plane of the first surface. A second edge dimension herein preferably indicates the extent of the transition in a manner perpendicular to the edge profile and in the plane of the second surface.

In one embodiment, the edge dimension of the transition is larger in that direction in which higher tensile stresses arise. For example, the tensile stresses may arise during operation, in particular in the case of thermal or mechanical loading.

Alternatively or additionally, mechanical stresses, in particular tensile stresses, may be generated during the manufacturing of the core component. For example, density variations may be created in a pressing procedure of a core component in the green state. The density variations depend inter alia on the geometric properties of the core component and, in particular, on the geometric shape of a transition. In one embodiment, the non-symmetrical transition is configured such that the density variations are kept as minor as possible.

In one embodiment, the core component has a face side. A clearance which has an edge with a non-symmetrical transition may be configured on the face side of the core component. For example, the first edge dimension runs in the height direction of the core component, and the second edge dimension runs so as to be perpendicular to the direction of the first edge dimension and perpendicular to the edge. The second edge dimension runs in a cross-sectional plane of the core component, for example. The core component has the basic shape of a cylinder, for example, in particular of a hollow cylinder. The edge runs in the radial direction of the core component, for example.

In one embodiment of the core component, the first edge dimension of the transition in the height direction is smaller than the second edge dimension of the transition, in particular than a second edge dimension that runs within a cross-sectional plane of the core component. It has been established that fissures in the core component may be particularly well prevented in the case of a geometric configuration of this type of the transition. In particular, the density variations in the core component that are created in the manufacturing process may be kept minor by way of a large extent of the transition in the cross-sectional plane. The precise extent of the transition within the cross-sectional plane may be optimized according to the geometric parameters of the core component and by way of a determination of mechanical stresses in the core component.

In one embodiment, the ratio of the edge dimensions in a first direction in comparison to a second direction is equal to or more than 1.1, the ratio preferably being equal to or more than 1.2. In one embodiment, the ratio of the edge dimensions is more than 1.0 and equal to or less than 2.5, the ratio preferably being more than 1.0 and equal to or less than 2.0. In one embodiment, the ratio of the edge dimensions is between 1.1 and 2.5, preferably between 1.2 and 2.0.

In one embodiment, the transition at least in portions has a rectilinear contour. The contour may have a plurality of rectilinear portions. In particular, these portions may have dissimilar gradients. For example, the contour is composed of two rectilinear portions. A first rectilinear portion runs up to the bisectrix of the imaginary sharp edge, for example. A second rectilinear portion of another gradient adjoins the latter.

In one embodiment, the transition at least in portions has an elliptic contour. In one embodiment, the transition has at least one parabolic contour.

In one embodiment, the transition at least in portions or entirely has an inwardly bulging shape. The transition is configured so as to be concave, in particular.

In one embodiment, the transition is free of sharp edges. In particular, edge regions of the transition may be rounded. In the case of a plurality of mutually adjoining rectilinear portions, for example, the transition regions between the portions are rounded.

In one embodiment, the edge is configured for routing through electrical wires. In particular, a clearance through which a wire may be routed is formed by the edge. The wire may be configured in particular for electrically connecting the core component or a further component. The core component is configured for receiving a further component, for example. The edge is configured for routing out an electrical wire from the further component, for example.

According to one further aspect of the present invention, a component arrangement from a core component and from one further component is disclosed. The core component of the component arrangement may have all functional and structural characteristics of the above-described core component. The further component is preferably received in the core component.

In one embodiment, the further component is configured as a wire-wound component. The wire may be routed out through the edge of the core component. The further component has a coil core, in particular a roll core, for example, about which an electrical wire is wound. The wound core may be configured as an inductor. This may be a power inductor, in particular. The component having the edge with the transition serves for magnetically shielding the further component, for example. This enables the assembly of a plurality of components with high density.

The afore-described features of the core component may be implemented in mutual combination or individually in a core component. The same applies to the core-component arrangement. Moreover, the features that have been described in the context of the core component also apply to the core-component arrangement, and vice-versa.

BRIEF DESCRIPTION OF THE DRAWINGS

The subject matter described herein will be explained in more detail hereunder by means of schematic exemplary embodiments which are not to scale.

In the figures.

DETAILED DESCRIPTION OF ILLUSTRATIVE EMBODIMENTS

In the figures hereunder, same reference signs preferably indicate functionally or structurally equivalent parts of the various embodiments.

Figure 1:
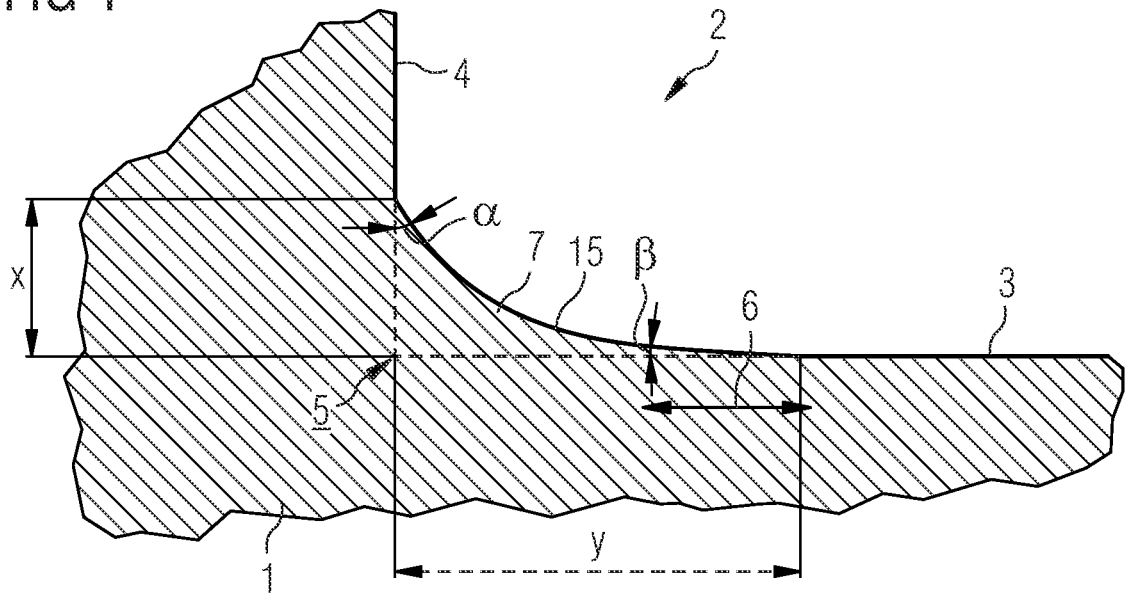
FIG. 1 shows a fragment of a core component with a non-symmetrical transition in a simplified sectional illustration.

FIG. 1 in a sectional illustration shows a fragment from a core component 1. The core component 1 is preferably configured as a ferrite core. The core component 1 is sintered, for example. The core component 1 may interact with a further core component. The further core component may be configured as a coil core, for example, and be wound with a coiling wire. The present core component 1 may be free of windings. Wires of the coil core may be routed out of the present core component 1 and be electrically connected. The core component 1 has outer dimensions in the range from 6 mm to 12 mm, for example.

The core component 1 has an edge 2. The edge is configured as an inner edge, for example. The edge 2 is configured in a clearance, for example, in order for electrical wires to be routed out. The edge 2 is formed by the convergence of two surfaces 3, 4 of dissimilar gradients. A first surface 3 is disposed in a horizontal manner; a second surface 4 is disposed in a vertical manner. Both surfaces 3, 4 run so as to be perpendicular to the image plane. If the surfaces 3, 4 were to converge in a transition-free manner, the core component 1 would have a sharp edge 5, the latter being indicated by a dashed line herein. Presently, this sharp edge 5 would be at an angle of 90°, running into the image plane. A sharp edge 5 is often a potential weak spot and may be the point of origin of fissures, in particular following mechanical or thermal loading.

In order for the robustness of the core component 1 to be increased, the edge 2 has a transition 7. The transition 7 is configured so as to be non-symmetrical. In particular, the transition 7 is not axially symmetrical in relation to a bisectrix of the imaginary sharp edge 5, or when viewed in a three-dimensional manner in relation to a bisectrix plane is configured so as not to be symmetrical in terms of area, respectively.

In particular, the transition 7 has dissimilar first and second edge dimensions x, y which in the picture run in a vertical or horizontal direction, respectively. The first edge dimension x in the vertical direction is smaller than the second edge dimension y in the horizontal direction. It has been established to be advantageous for the edge dimension to be chosen to be particularly large in that direction in which large tensile stresses arise, i.e. presently in the horizontal direction. The ratio of the edge dimensions y, x is preferably more than 1.1; particularly preferably said ratio is at least 1.2. For example, the ratio is more than 1.0 and smaller than or equal to 2.0. The exact value of the edge dimensions x, y depends inter alia on the dimensions of the core component 1. For example, the edge dimension x in the vertical direction is 1.0 mm.

The transition 7 has an inwardly bulging shape. The contour 15 of the transition has a parabolic profile. In relation to a mathematical extension of the second surface 4, the contour line of the contour 15 forms an acute angle $\alpha$ of more than 20°. The contour line approaches the first surface 3 in an approximately asymptotic manner, at the intersection point forming as small an angle as possible with the surface 3, for example an angle $\beta$ of less than 5°.

The transition 7 according to the invention may have another profile and an another orientation than is shown in FIG. 1. In particular, the transition 7 may also be rotated arbitrarily by 0° to 360° about the central axis thereof or about an arbitrary axis.

Alternatively or additionally, the core component 1 may have an outer edge with a non-symmetrical transition. In the case of an outer edge, the term "removal" may also be used instead of the term "transition".

Figure 2A:
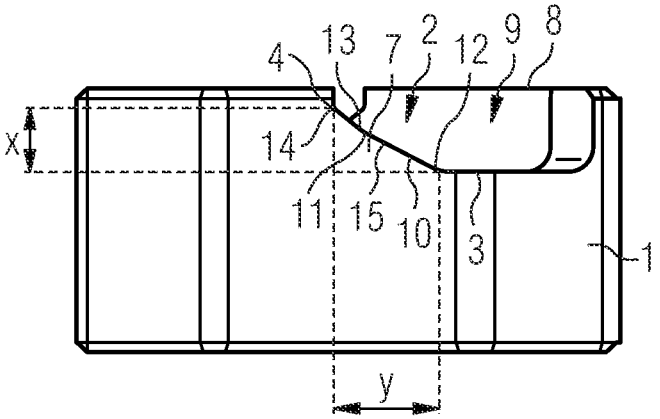
FIG. 2A shows a first embodiment of a core component with a non-symmetrical transition in a lateral view.
Figure 2B:
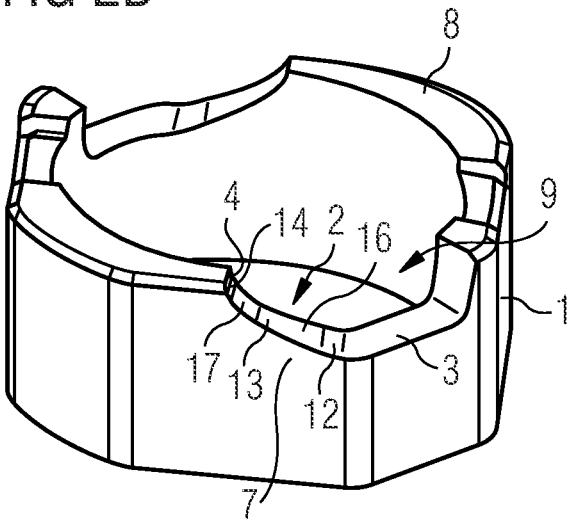
FIG. 2B shows the core component of FIG. 2A in a perspective view.

FIG. 2A in a lateral view shows a first embodiment of a core component 1 with a non-symmetrical transition 7. FIG. 2B shows this core component 1 in a perspective view. The core component 1 has the basic shape of a cylinder, in particular of a circular cylinder. The core component 1 is configured as a hollow cylinder. A face side 8 of the core component 1 is configured so as to be structured. In particular, a clearance 9 through which wires may be routed, for example, is provided. By virtue of the clearance 9 the core component 1 has regions of dissimilar heights. In particular, the core component 1 within the clearance 9, in particular on the surface 3 in the clearance 9, has a smaller height than on a region of the face side 8 in which no clearance 9 is configured.

The circular or annular base area of the cylinder is merely intended to be an example. The base area may also be of rectangular, oval, or any other shape, for example. For example, the core component has the basic shape of a cuboid. The core component may also have a shape other than a cylindrical shape. For example, the core component has an ellipsoid basic shape.

The core component 1 within the clearance 9 has an edge 2 with a transition 7. The transition has a first edge dimension x which is smaller than a second edge dimension y. The second larger edge dimension y runs in the plane of a cross section of the core component 1. In the present picture, this would be a horizontal plane through the core component 1 of FIG. 2A. It has been demonstrated that the robustness of the core component 1 may be increased by way of a larger edge dimension y in the plane of the cross section.

The transition 7 has a contour 15 with two rectilinear portions 10, 11. It can be seen in the perspective view of the core component 1 in FIG. 2B that the rectilinear portions 10, ii of the contour 15 represent the contours of two level planar regions 16, 17. The rectilinear portions 10, 11 have dissimilar gradients. In particular, the gradient of the first rectilinear portion 10 is less than the gradient of the second rectilinear portion. Accordingly, the two level planar regions 16, 17 are dissimilarly inclined. The transition regions 12, 13, 14 between the rectilinear portions 10, 11 and the adjoining first and second surfaces 3, 4 are in each case rounded.

For example, the first rectilinear portion 10 may run up to the bisectrix, and the second rectilinear portion 11 may adjoin thereto.

The geometry of the transition 7 may be optimized as follows, for example. A core component 1 which is configured like the core component 1 of FIGS. 2A and 2B but has a symmetrical transition, in particular a symmetrical chamfer, is manufactured. The core component 1 may be manufactured for real or by way of a simulation. The chamfer has a rectilinear contour, for example, and with the two surfaces 3, 4 forms an angle of 45°. The precise position of the intersection points of the contour line and the surfaces 3, 4 depends on the geometric realities of the core component 1. The mechanical stresses in the core component 1 are subsequently established, for example by way of a simulation or in a physical drop test. Thereafter, that edge dimension of the transition that lies on the same side of the bisectrix of the imaginary sharp edge as the largest mechanical stresses in the region of the transition is enlarged. The new transition in one direction now has the previous edge dimension, and in the other direction has an extended edge dimension. The new contour of the transition may be configured so as to be rectilinear, for example. Alternatively, the new contour may be assembled from a plurality of rectilinear portions, for example. The contour on that side of the bisectrix that is assigned to the edge dimension to be retained is retained, for example. Then, proceeding from the intersection point of the contour line and the bisectrix on that side of the bisectrix that is assigned to the extended edge dimension, a further straight portion is configured such that the transition in this direction now has the second edge dimension.

Figure 3A:
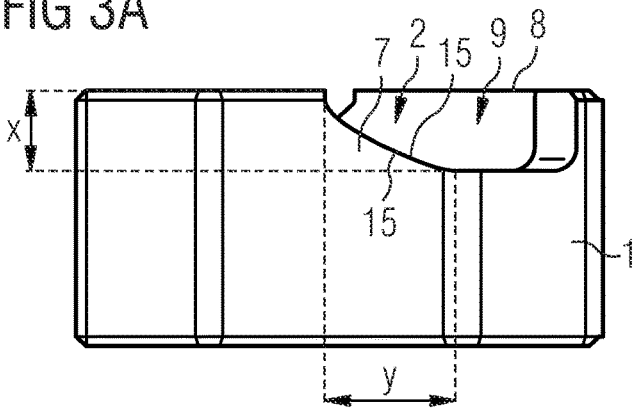
FIG. 3A shows a second embodiment of a core component with a non-symmetrical transition in a lateral view.
Figure 3B:
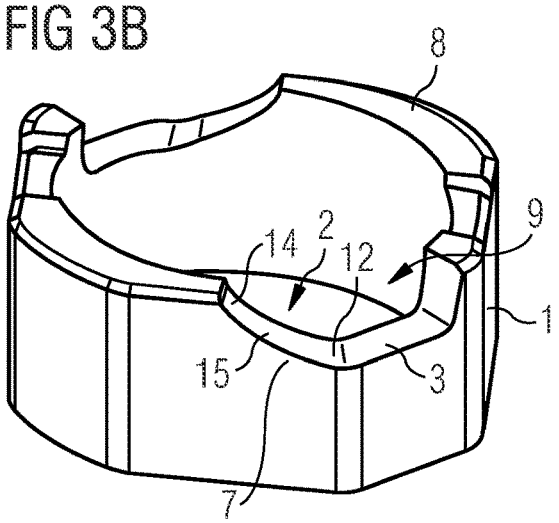
FIG. 3B shows the core component of FIG. 3A in a perspective view.

FIG. 3A in a lateral view shows a second embodiment of a core component 1 with a non-symmetrical transition 7. FIG. 3B shows this core component 1 in a perspective view. The core component 1 shown here is configured so as to be substantially identical to the core component 1 of FIGS. 2A and 2B; however, the former has another geometry of the non-symmetrical transition 7.

The transition 7 has an elliptic contour 15. The edge dimension x in the height direction corresponds to the minor semiaxis of the ellipse, and the edge dimension y corresponds to the major semiaxis of the ellipse.

The stability of a core component 1 having a non-symmetrical transition as shown in FIGS. 2A and 2B was established by a drop test. For comparison, a drop test was carried out with core components in which the transition was configured as a symmetrical chamfer. The core components 1 with a non-symmetrical transition displayed higher stability in the drop test.

Figure 4:
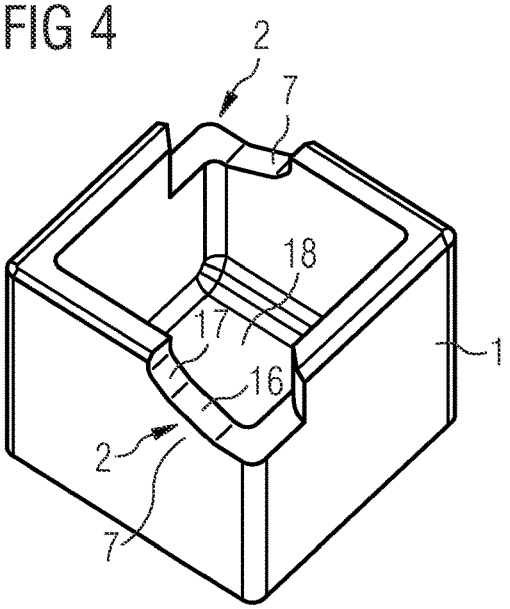
FIG. 4 shows a third embodiment of a core component with a non-symmetrical transition in a perspective view.

FIG. 4 in a perspective view shows a third embodiment of a core component 1 with a non-symmetrical transition 7. The core component 1 is configured as a cuboid. A cuboid may be considered to be a cylinder with a rectangular, for example a square, base area. The core component 1 has a closed bottom 18. The core component 1 forms a housing, for example. The core component has two edges 2, each with a non-symmetrical transition 7. The transition 7 is configured as in FIGS. 2A and 2B.

The invention claimed is:

1. A core component being a cylinder comprising:

a first surface and a second surface of the cylinder; and at least one edge having a non-symmetrical transition of the cylinder, wherein the edge is arranged between the first surface and the second surface, wherein the second surface extends along a height direction of the cylinder and the first surface extends perpendicular to the height direction, and wherein the non-symmetrical transition encloses an angle larger than 20° and smaller than 90° with a mathematical extension of the second surface within a material of the core component.

2. The core component according to claim 1, wherein the non-symmetrical transition in dissimilar directions has dissimilar edge dimensions (x, y).

3. The core component according to claim 1, wherein the core component comprises a face side comprising a clearance, and wherein the edge with the non-symmetrical transition is provided in the clearance.

4. The core component according to claim 1, wherein the non-symmetrical transition is configured to reduce mechanical stresses in the core component.

5. The core component according to claim 2, wherein a ratio of the edge dimensions (x, y) of the non-symmetrical transition in a first direction in comparison to a second direction is equal to or more than 1.2.

6. The core component according to claim 1, wherein a first edge dimension (x) of the non-symmetrical transition in the height direction is smaller than a second edge dimension (y).

7. The core component according to claim 1, wherein the core component comprises regions with dissimilar heights, and wherein the edge is located between regions of dissimilar heights.

8. The core component according to claim 1, wherein the non-symmetrical transition at least in portions has a rectilinear contour.

9. The core component according to claim 1, wherein the non-symmetrical transition at least in portions has an inwardly bulging shape.

10. The core component according to claim 1, wherein the non-symmetrical transition at least in portions has an elliptic contour.

11. The core component according to claim 1, wherein the non-symmetrical transition is free of sharp edges.

12. The core component according to claim 1, wherein the edge is located on a face side of the core component.

13. The core component according to claim 1, wherein the core component is configured to receive a further component.

14. The core component according to claim 1, wherein the edge is configured to route through a wire.

15. A component arrangement comprising:

the core component according to claim 1; and a further component located in the core component.

16. The component arrangement according to claim 15, wherein the further component is a wire-wound component, and wherein a wire is routed out through the edge of the core component.

17. The core component according to claim 1, wherein the non-symmetrical transition at least in portions has a parabolic contour.

18. The core component according to claim 1, wherein the non-symmetrical transition encloses an angle smaller than 5° with a mathematical extension of the first surface within the material of the core component.

* * * * *